US006368459B1

(12) United States Patent
Kinnunen

(10) Patent No.: US 6,368,459 B1
(45) Date of Patent: Apr. 9, 2002

(54) METHOD AND APPARATUS FOR COATING A MOVING WEB OF PAPER OR BOARD

(75) Inventor: Jorma Kinnunen, Järvenpää (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/623,149

(22) PCT Filed: Mar. 2, 1999

(86) PCT No.: PCT/FI99/00162

§ 371 Date: Aug. 28, 2000

§ 102(e) Date: Aug. 28, 2000

(87) PCT Pub. No.: WO99/45203

PCT Pub. Date: Sep. 10, 1999

(30) Foreign Application Priority Data

Mar. 3, 1998 (FI) ..... 980483

(51) Int. Cl.[7] ..... D21F 5/00; D21H 17/00; D21H 25/00

(52) U.S. Cl. ..... 162/207; 162/136; 162/137; 162/204; 118/643; 118/60; 118/62; 118/67; 34/421; 34/422; 34/454; 34/465; 34/623

(58) Field of Search ..... 162/112, 119, 162/135, 136, 137, 184, 201, 204, 206, 265, 207; 118/641, 642, 643, 58, 62, 66, 67, 68, 60; 34/419, 421, 422, 444, 454, 459, 465, 623

(56) References Cited

U.S. PATENT DOCUMENTS

| | | | | | |
|---|---|---|---|---|---|
| 4,728,396 | A | * | 3/1988 | Alheid | 162/193 |
| 4,848,633 | A | * | 7/1989 | Hagen et al. | 226/97 |
| 5,314,738 | A | * | 5/1994 | Ichikawa | 428/182 |
| 5,547,509 | A | | 8/1996 | Neider et al. | |
| 5,641,387 | A | * | 6/1997 | Baldini | 162/265 |
| 5,712,489 | A | * | 1/1998 | Elvidge | 250/559.43 |
| 5,817,215 | A | * | 10/1998 | Kinnunen | 162/193 |
| 6,051,068 | A | * | 4/2000 | Kohl et al. | 118/641 |
| 6,119,362 | A | * | 9/2000 | Sundqvist | 34/120 |

FOREIGN PATENT DOCUMENTS

| | | | |
|---|---|---|---|
| DE | 40 29 487 A1 | 4/1991 | D21F/5/00 |
| EP | 0 596 365 A1 | 5/1994 | D21H/23/70 |
| WO | WO 95/14816 | 6/1995 | D21H/23/70 |
| WO | WO 95/28522 | 10/1995 | D21H/23/42 |

* cited by examiner

*Primary Examiner*—Peter Chin
*Assistant Examiner*—Eric Hug
(74) *Attorney, Agent, or Firm*—Cohen, Pontani, Lieberman & Pavane

(57) ABSTRACT

A method and apparatus for coating a moving web of paper or board from on sides with at least one coat layer. The coat is applied to the web by means of a film transfer coater (12) and next the web is passed to a dryer cylinder group (4) via an air-cushion cylinder (18) supported by a wire (14), whereby the web can run fully supported all the way from its entry to the coater up to the winder. The apparatus further comprises a belt calender (8) and a belt-supported winder (9), whereby the web is thus supported over its entire passage in the machinery from the unwinder or paper machine up to winding.

43 Claims, 3 Drawing Sheets

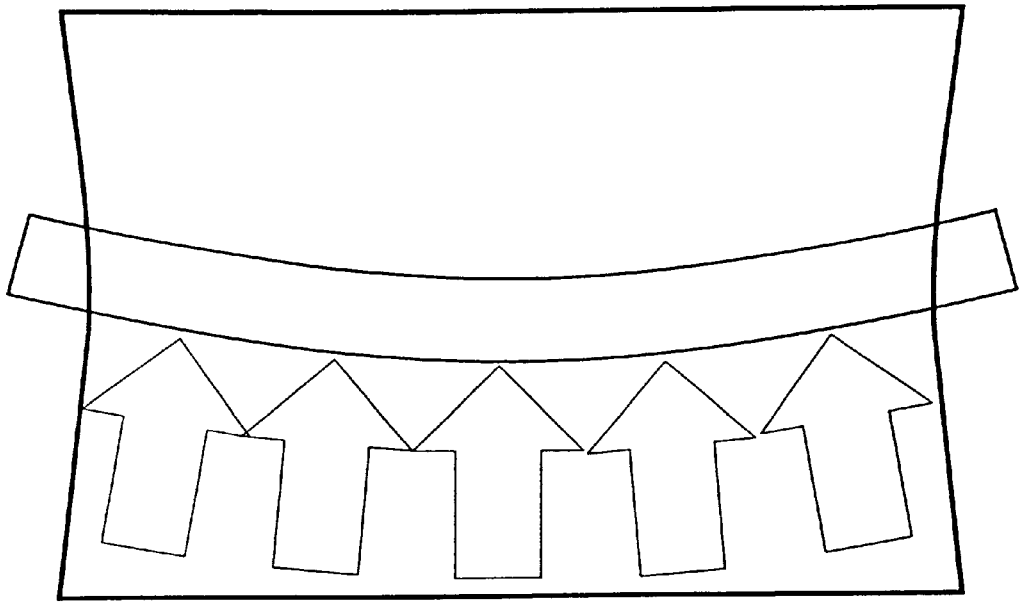
FIG. 3
FIG. 4
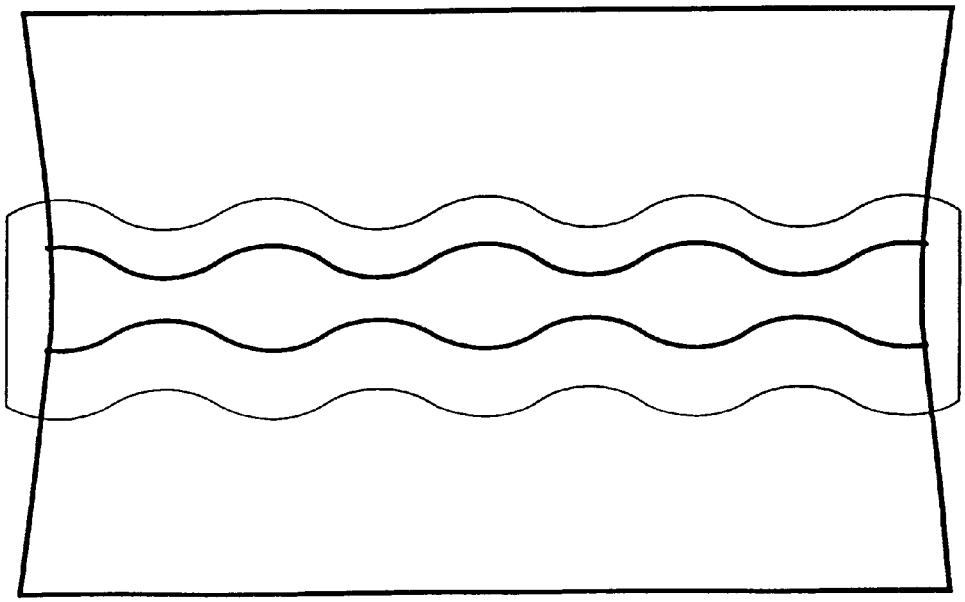

METHOD AND APPARATUS FOR COATING A MOVING WEB OF PAPER OR BOARD

Method and apparatus for coating a moving web of paper or board

FIELD OF THE INVENTION

The present invention relates to a method and apparatus for two-sided coating of a moving paper or board web with at least one coat layer.

BACKGROUND OF THE INVENTION

In the coating of a paper web, to a base sheet manufactured in a paper machine is applied a coating mix layer that is smoothed to a desired thickness. The coating mix is made by slurrying coat solids into water and the web is dried after coat application prior to its entry into the subsequent finishing steps. The coater machine can be placed either directly after the paper machine manufacturing the base sheet, whereby the arrangement is called an on-line layout, or alternatively, as a separate section to which the wound base sheet rolls are transported to be unwound there and coated in an entirely separate off-line coater.

The production capacity of a coater machine is chiefly dictated by its width, web speed and reliability of the machine function. The most important factor affecting the functional reliability is the number of web breaks that should be kept as small as possible. Today, paper machines and coaters are already very wide, up to about 8–10 m, and a greater width is extremely difficult to achieve due to a number of reasons including the greater bowing of rolls. Hence, the productivity of paper machines and coaters is preferably improved by elevating the web speeds in these machines. However, at higher web speeds also the web run in the coater becomes more difficult to control. One major problem is caused by the boundary air layer travelling on the rapidly moving web that tends to detach the web from its support rolls. If the web loses its contact with the support rolls, control of web run becomes impossible and, respectively, loss of web contact with the backing roll at the applicator causes bagginess and problems in the application and smoothing of the applied coat. Hence, the control of web run in fast coating machines must be accomplished by means different from those used in prior-art machines. The most common technique is to use an at least partially supported web run through the machine. When the web is passed supported by an air-permeable wire or belt, the formation of an air layer between the web and the support wire or belt is prevented, thus allowing the web to stay in intimate contact with the surface of the support means. Further, a supported web run is an effective measure to reduce the number of web breaks due to variations in web tension, because tensioning of the web itself is not needed.

Instead of a wire, an air-cushion-type support means can be used in a coater for guiding the web run after coating, thus avoiding physical contact of any mechanical elements with the web. However, the air-cushion supported web guidance requires a substantially bulky free space particularly in the vertical dimensions of the machine, because the web cannot be guided by an air-cushion turning means in substantially sharp bends, particularly not through a sequence of sharp bends. Air-cushion-supported web run also needs dedicated means for threading the web trailing end through air dryers and air-cushion turning devices, because air dryers and air-cushion turning devices are incapable of pulling the web forward, but rather, the web must be drawn through the dryer units by means of pulling roll group or similar pulling means located after the dryer section and capable of maintaining a sufficiently tight web draw. However, this arrangement also involves the risk of web breaks due to variations in web tension.

In the manufacture of a coated paper grades, the current trend is to use a base sheet as thin as possible because the quality of the finished paper can be improved by coating in a better manner than by increasing the thickness of the base sheet and, moreover, the cost of the coat is appreciably lower than that of the base sheet. Obviously, the strength of a thinner base sheet is much lower and, hence, the risk of web breaks particularly when the base sheet becomes wet in application of the coating will be greater the thinner the base sheet that is used. Hence, the choice of a suitable application method is a particularly vital question in machines running at high web speeds and making thin paper grades. The optimal coating techniques for fast machines are such applications methods as film transfer application, jet application and spray application which impose a minimal stress on the web and cause a minimum penetration of coating mix and moisture into the web. Particularly advantageous herein is that these application methods at best can apply only so much coat to the web that no doctoring after application is required. Obviously, the stress of application on the web is thus minimized. When this kind of an application method causing a minimum stress on the web is combined with, e.g., an entirely belt- and wire-supported web run through the entire machine, the system can be made to operate extremely reliably even at high web speeds.

SUMMARY OF THE INVENTION

It is an object of the present invention to provide a method capable of permitting a substantial speed increase of a paper web coating machine, yet simultaneously keeping the vertical and machine-direction space requirements of the machine within reasonable dimensions.

The goal of the invention is achieved by way of advantageously using a film transfer coater for applying the coat to the web and then passing the web to a dryer cylinder group over a wire-supported air-cushion cylinder, thus making it possible to support the web over its entire run from application to the end of drying.

According to a preferred embodiment of the invention, the apparatus also includes a belt calender and a beltsupported winder, whereby the web is essentially supported over its entire run from the unwinder or paper machine exit end to the winder.

The invention offers significant benefits.

By virtue of the invention, the coater design can be made very compact and the web can be easily passed from the support elements of one paper machine section to the next. The web run is entirely supported except for a short length at the web tension measurement equipment, thus allowing the frequency of web breaks to be reduced to a minimum. The web is coated in a film transfer coater and then passed to a first dryer member which is a cylinder with an air-cushion function. On the air-cushion cylinder, the web surface is dried by air ejected through the cylinder shell, while the web is simultaneously supported by the wire and guided by its edges resting against the cylinder rims. Using belt supported top-side film transfer coaters, the coat can be applied to the upper surface of the web, whereby the length of web run is minimized. With the help of the air-cushion cylinder, the web can be passed via a very uncomplicated path to the dryer cylinders without marring the applied coat, yet keeping the length of web run at a minimum. The web is dried finally in a wire-supported dryer cylinder section and subsequently passed on the support belt of the next coater section. Here, the other side of the web is coated by film transfer applicators and the web is passed over an air-cushion cylinder to the next dryer cylinder section in the same manner as described above, whereby the construction and web run of the second coater/dryer section becomes very uncomplicated, too. The equipment may be very advantageously combined with a belt-supported calender and a belt-supported winder, whereby the web will run fully supported all the way starting from its entry to the coater and ending at the winder.

BRIEF DESCRIPTION OF THE DRAWINGS

In the drawings, wherein like reference numerals delineate similar elements throughout the several views:

FIG. 3 shows schematically one technique of wire width narrowing; and

FIG. 4 shows schematically another technique of wire width narrowing.

Figure 1:
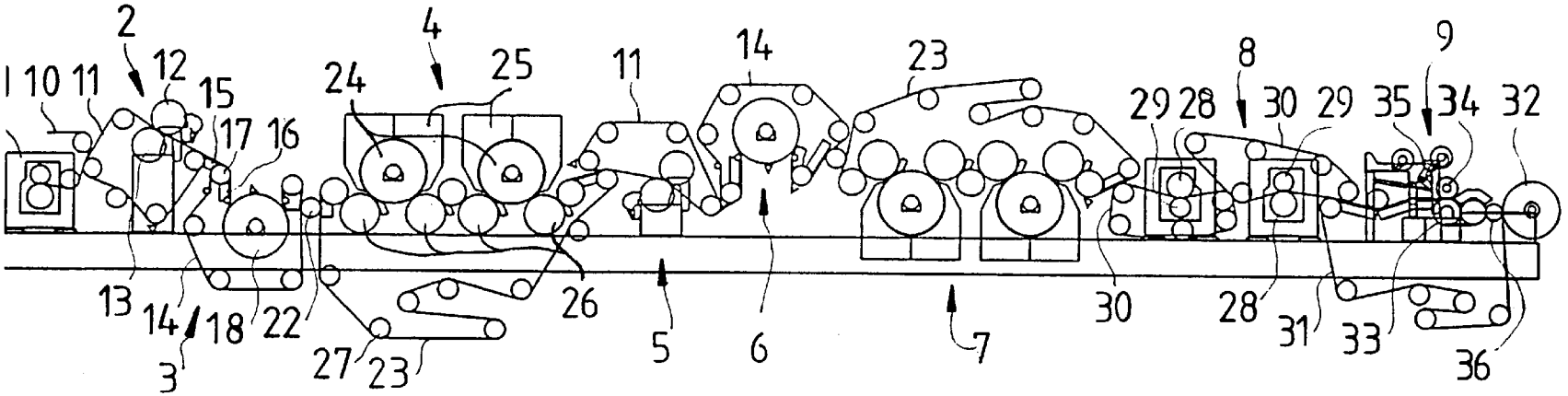
FIG. 1 shows schematically an embodiment of a coater according to the invention.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

DETAILED DESCRIPTION OF THE PRESENTLY PREFERRED EMBODIMENTS

The coater machine shown in FIG. 6 comprises an on-machine applicator, whereby the paper web passed thereto is first introduced to an intervening calender 1, from which the web is passed forward in the machine.

In the machine, the web is first passed to a first film transfer coater 2 in which the coat is applied to the top side of the web. From the film transfer coater 2, the coated web is passed over an air-cushion cylinder 3 to a dryer cylinder section 4. From the dryer section 4, the web is further passed to the next film transfer coater 5 in which the bottom side of the web is coated. After the bottom side of the web is coated, the moist web is passed to a second air-cushion cylinder 6 and further to a second dryer cylinder section 7. The dried web is next passed onto a first calender belt of a belt calender 8 and, supported thereon, into the first calender nip, therefrom onto the second calender belt and into the second calender nip. From the calender 8, the web is passed to a belt-supported winder 9.

The web is passed to the coater from a support belt 10 on which the web runs when it is passed to the support belt 11 of the first film transfer coater.

Figure 2:
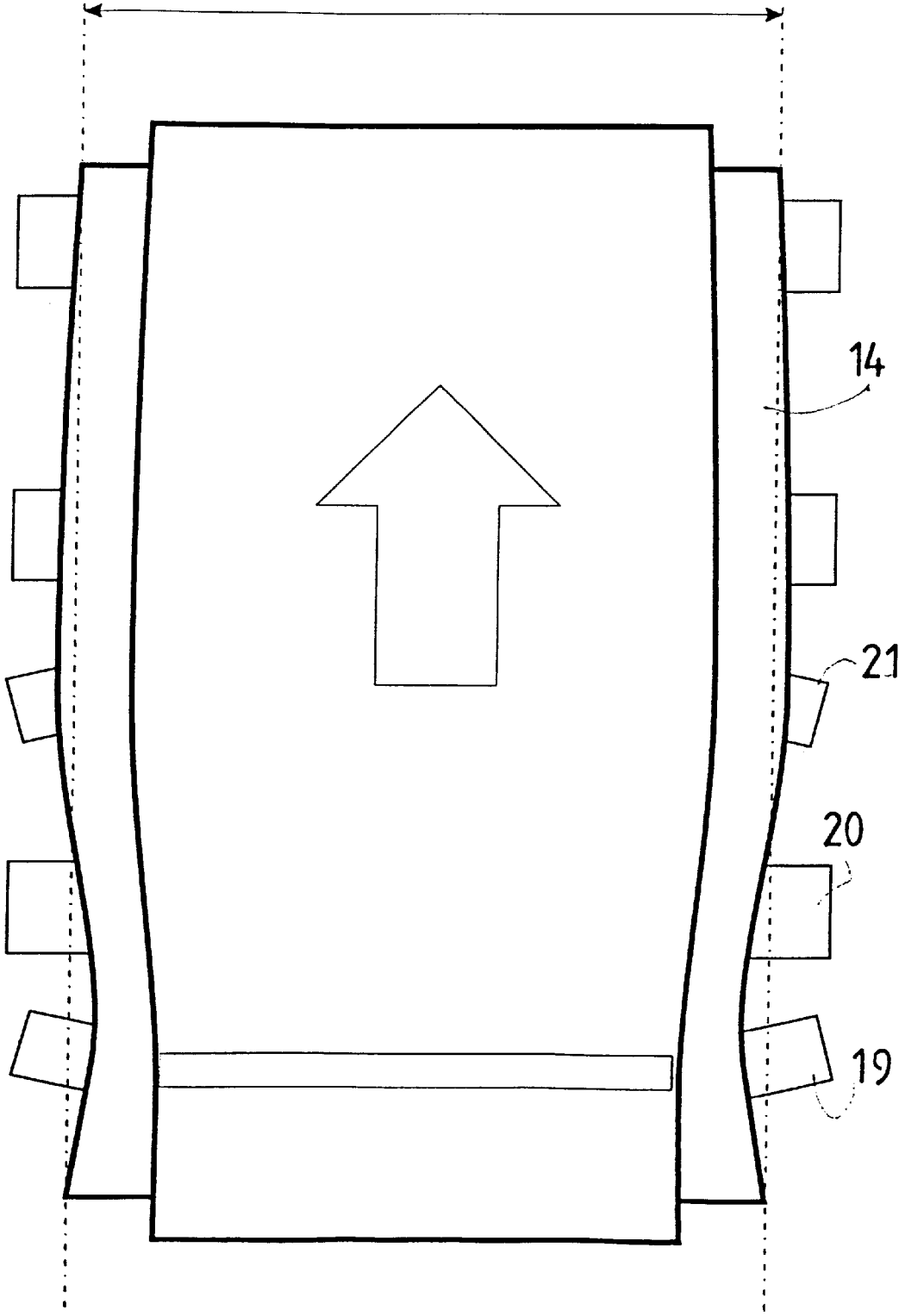
FIG. 2 shows schematically the principle of web spreading by means of the wire width control.

The first coater station 2 is a top-side film transfer coater in which the upper roll 12 of the coater acts as the applicator roll. The support belt 11 passes over a lower roll 13 which serves as the backing roll of the film transfer coater. In this manner, the web can be guided maximally smoothly from the intermediate calender or post-dryer section of the paper machine, or in an off-line coater machine, from the unwinder, to the film transfer coater and, therefrom, forward along a maximally straight path. From the support belt of the film transfer coater 2, the web runs unsupported over a short distance to the support wire of the air-cushion cylinder. On the web passage from the support belt 11 of the film transfer coater to the support wire 14 of the air-cushion cylinder is adapted a scanning beam 15 of web tension measurement equipment based on sensing with air-jet injection for measuring the web tension and its tension profile, whereby these data are used for controlling the draw between the film transfer coater and the subsequent equipment. A draw-based web tension control scheme is necessary because the web dimensions change with the variation of the web moisture content during coat application. The web meets the support wire of the air-cushion cylinder at a guide roll 17. Between this guide roll 17 and the air-cushion cylinder 18 is adapted a web spreading device 16 as shown in more detail in FIG. 2.

Web elongation due to due to the wetting of the web at the coater may be compensated for by controlling the machine draws and web tension. However, the increase of web width must be compensated for by means of separate devices capable of spreading the web, thus keeping the web smoothly adhering to the support wires and belts. When the web is passed from the coater station to the support wire as in the exemplifying embodiment illustrated in FIG. 1, web spreading can be implemented by narrowing and spreading the support wire 14. This is accomplished by means of passing the web in the coater station from the support belt 11 to the support wire at the wire-narrowing bowed roll, more exactly, by adapting the web to meet the support wire exactly at the wire-narrowing roll. The wire-narrowing roll 19 may be either a conventional reverse-mounted spreading roll 19 of the type shown in FIG. 3 comprised of roll segments mounted on a bowed shaft, or alternatively, a so-called worm roll of the type shown in FIG. 4, whereby the contoured surface of the roll provides the wire-narrowing effect. At the wire-narrowing roll 19, the wire width is narrowed due to the cross-machine elasticity of the wire, thus allowing the web to meet a narrowed support wire. When leaving the wire-narrowing roll, the wire tends to recover its normal width, whereby also the web is spread correspondingly. Next, the support wire with the web travelling thereon can be passed to a conventional straight guide roll 20, after which a separate spreading roll 21 can be additionally used if so required to compensate for web spreading. As the moisture content of the web is reduced in later sections, the web width becomes narrower thus causing the web to shrink with respect to wire, whereby no creasing or separation of the web from the support wire can occur in the same manner as takes place with the increase of the web width.

In the support wire used for spreading the web, the available spreading capacity should be at least 0.5%, preferably greater than 1%, combined with a low elasticity. The wire should also offer a good adherence to the web and the wire-narrowing roll, which means that the coefficient of friction on the wire surface should be high. If the wire is used as a dryer wire, it must have good resistance to high temperatures and, further, the aerodynamic properties of the wire need to be good at high web speeds. Obviously, the wire should be easily guidable, it may not crease when passing over the wire-narrowing roll, and it should have a sufficiently long service life. The meeting point of the web with the wire must be arranged to fall on the narrowed portion of the wire.

Subsequent to coating, the first dryer member in the layout according to the invention is an air-cushion cylinder 18. This device comprises a pressurized cylinder whose shell is perforated with holes through which hot air or steam is injected outward and against which the running web is supported by the wire 14. The coated top side of the web faces the air-cushion cylinder, while the uncoated bottom side of the web is supported by the wire 14. With the help of the air jets injected radially outward from the air-cushion cylinder 18, the web runs noncontactingly over the surface of the air-cushion cylinder 18 and thus the web is contactingly supported but for a short machine-direction length by its edges that are pressed by the wire 14 against the end deckles of the air-cushion cylinder 18.

As can be seen from FIG. 1, the web path from the film transfer coater 2 to the air-cushion cylinder 18 is very short and straight. In a similar fashion, the web can also be passed to the next dryer member practically in the same horizontal plane as it approaches the air-cushion cylinder. Thus, the web meets and leaves the air-cushion cylinder in the same horizontal level.

The web is passed from the wire of the air-cushion cylinder by means of a pick-up roll 22 to the support wire 23 of the dryer cylinder group. The pick-up roll 22 is adapted to rest against the wire 14 of the air-cushion cylinder 18 and, respectively, against the wire 23 of the dryer cylinder group 4, and the web is passed from the wire 14 of the air-cushion cylinder 18 about the pick-up roll 22 to the wire 23 of the dryer cylinder group 4. The dryer cylinder group 4 includes the wire 23 running over guide rolls 27, smooth web-contacting dryer cylinders 26, air-permeable air-impingement dryer cylinders 24 and high-velocity hoods 25 adapted about said air-impingement dryer cylinders. The basic members of the dryer group 4 are two air-impingement dryer cylinders 24 having smooth web-contacting dryer cylinders 26 adapted to their both sides. All the dryer cylinders are so located with regard to each other that the wire with the web supported by it will be wrapped by over 180° about each cylinder. After being partially dried at the air-cushion cylinder 18, the web is next passed to the first smooth dryer cylinder 26, where the support wire presses the coated side of the web against the surface of the smooth dryer cylinder 26. Here, the hot cylinder evaporates the moisture of the web and its smooth surface partially smooths the surface of the coat adhering thereto. Next, the wire 23 and the web running supported by the same are passed to a first air-impingement dryer cylinder 24 having high-velocity hoods 25 adapted there about. The interior of the hoods 25 is provided with a plurality of nozzles serving to blow a drying gas at a high velocity onto the web running on the wire 23. Depending on the moisture content of the web and other factors, hot air or superheated steam may be used as the drying gas. The dryer cylinder group comprises four smooth-surface dryer cylinders 26 and two larger-diameter air-impingement dryer cylinders 25. The larger-diameter dryer cylinders are placed between the smooth dryer cylinders so that the web can be passed first to one smooth dryer cylinder, then to one large-diameter dryer cylinder 24 and further to a second smooth dryer cylinder 26. The large-diameter dryer cylinders 24 may be either suction cylinders, which are permeable to the drying gas and brought to a vacuum, or alternatively, air-impingement dryer cylinders having a surface grooved so as to allow the drying gas impinging thereon to escape via the backside of the wire 23. The smooth surface cylinders are mounted in the same horizontal plane so that the height at which the web runs over these cylinders is located close to the web meeting/leaving point on the air-cushion cylinder surface, whereby the length of web run is reduced to the shortest possible distance and the coater space requirement in the vertical direction can be minimized.

After the web supported by the wire 23 of the dryer cylinder group 4 has passed through the entire dryer cylinder section it is delivered supported by the wire 23 to the support belt 11 of the next coater station 5. Here, coat is applied to the other side of the web, that is, to the web bottom side which remained uncoated after leaving the preceding coater station 2. Next, the support belt 11 of the coater station 5 runs about the upper roll of the film transfer coater, whereby said upper roll acts as the backing roll of the coater. Herefrom, the web is passed to the dryer section of the line which is otherwise similar to that of the preceding coater section except for having the support wires and belts adapted to pass above the section members and, respectively, having the larger-diameter dryer cylinders 24 of this second dryer cylinder group 7 adapted below the smooth-surface dryer cylinders 26. Also herein, the smooth dryer cylinders are placed in the same horizontal plane and the meeting/leaving point of the web on the air-cushion cylinder is located in the vertical direction close to the plane in which the web runs over the smooth cylinders.

From the dryer group 7, the web is passed to a belt calender 8 comprising two support belts and two calender nips. Each of the calender nips comprises one calender roll 28 with a cooperating backing roll 29. The calender belt 30 wraps about the backing roll, whereby the web passed to the calender belt travels through the nip between the calender roll 28 and the calender belt 29. In the first calender nip, the calender roll is placed above the calender belt, and in the second calender nip, respectively, the calender roll is placed below the calender belt 30. Thus, both sides of the sheet will be contacted with both the calender roll and the calender belt during calendering. In a similar manner as in all preceding sections, the web is passed from one nip to the next supported by the calender belts so that the web run takes place supported along its entire length.

The winder 9 is of an entirely belt-supported type in which the web is passed supported by a support belt 31 up to the paper/board roll 32. The winder comprises a winder cylinder 33 and a winder mandrel 34 forming a nip through which the web is passed onto the mandrel. The winder further includes a transfer device 35 for bringing a new mandrel into a nip contact with the winder cylinder 33 when the paper or board roll wound about the previous mandrel is full. The support belt 31 of the winder 9 passes via the last nip formed by the calender belt 30 in calender 8 and then travels to the winder cylinder 33. The change of the roll mandrel 34 takes place by moving the guide roll 36 of the support belt 31 so that the web is supported during the entire change-over operation by the support belt 31 and all the time passes through the nip between guide roll 36 and the paper/board roll 32. Simultaneously a new roll is brought into contact with the web supported by the support belt 31 and the web is severed so that it starts to wind up about the new roll mandrel 34. This type of winder is disclosed in FI laid-open publication no. 94,231.

In addition to those described above, the invention may have alternative embodiments.

The equipment layout described above is suited for two-sided coating of a paper or board web with one coat layer on each side. Obviously, a similar arrangement can be adapted to coaters in which both sides of the web are coated with multiple layers of coating. Then, the coater must be provided with the required number of coater and dryer units, each comprising an air-cushion cylinder and a dryer cylinder group. The arrangement according to the invention can be used equally well as an on-line or an off-line coater.

In the above-described embodiment, the first coater station is configured as a top-side coater, while the latter is a bottom-side coater. Obviously, the order of the coater stations may be reversed and the film transfer coater used therein may be replaced by other techniques such as jet and spray applicators suitable for top-side coating. In the bottom-side coater station, also other coating methods are applicable inasmuch a majority of conventional coater constructions are designed for bottom-side coating from below the web. Obviously, the number of the dryer cylinders may be varied in such a manner that, e.g., only one air-impingement dryer cylinder is used after each coater station or some of the coater stations. Also herein, a sufficient number of web-contacting dryer cylinders are typically required, but where a particularly low drying effect is desired, the web-contacting dryer cylinders may even be omitted. In practice, the number of dryer cylinders is determined by the needed drying effect.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for coating a web of paper or board comprising:

passing the web through a coater where a coat layer is applied to a first side of the web, the web being supported by a belt in the coater;

passing the web from the coater through a first dryer where moisture is removed from the web, the first dryer comprising an air-cushion cylinder and a wire positioned to support a second side of the web so that the first side of the web faces the air-cushion cylinder; and passing the web from the first dryer through a second dryer where moisture is removed from the web, the second dryer comprising at least one smooth-surfaced dryer cylinder, at least one air-impingement dryer cylinder and a support wire, the wire being positioned to support the web so that the coated first side of the web wraps about a portion of a surface of the at least one smooth-surfaced dryer cylinder and so that the web wraps about a portion of a surface of the at least one air-impingement dryer cylinder, wherein drying gas is blown against the web as the web passes about the at least one air-impingement dryer cylinder.

2. The method of claim 1, further comprising contracting a width of the wire of the coater with a wire-narrowing roll, wherein the web first contacts the wire of the first dryer at a point where the width of the wire is contracted so that spreading of the wire downstream of the wire-narrowing roll to a natural width of the wire also spreads the web.

3. The method of claim 2, further comprising widening the width of the wire of the first dryer with a wire-spreading roll positioned downstream of the wire-narrowing roll.

4. The method of claim 1, further comprising measuring tension of the web as the web passes from belt of the coater to wire of the first dryer, the web tension being measured by a web tension measurement device.

5. The method of claim 4, wherein the web is supported substantially at all times as it travels through the coater, the first dryer and the second dryer, from the coater to the first dryer, and from the first dryer to the second dryer, except as the web passes by the web tension measurement device.

6. The method of claim 1, wherein the web and the wire supporting the web through the first dryer wrap about a portion of the air-cushion cylinder so that the web initially faces the air-cushion cylinder in substantially the same horizontal plane as the web leaves the air-cushion cylinder.

7. The method of claim 1, wherein the second dryer comprises at least two air-impingement dryer cylinders and at least two smooth-surfaced dryer cylinders, and wherein the at least two smooth-surfaced dryer cylinders are positioned in a horizontal plane.

8. The method of claim 1, wherein the second dryer comprises at least two smooth-surfaced dryer cylinders positioned in a horizontal plane.

9. The method of claim 1, wherein the web is passed from the wire of the first dryer to the support wire of the second dryer by a pick-up cylinder which contacts the wire of the first dryer and the support wire of the second dryer.

10. The method of claim 1, further applying a coat layer to a second side of web.

11. The method of claim 1, further comprising applying another coat layer to the first side of the web.

12. The method of claim 10, further comprising applying another coat layer to the first and second sides of the web.

13. The method of claim 10, further comprising drying the applied coat layers.

14. The method of claim 13, further comprising, after drying the applied coat layers, transferring the web onto a first calendar belt through a first calender nip.

15. The method of claim 14, further comprising transferring the web downstream of the calender nip from the first calender belt to a second calender belt and passing the web on the second calender belt through a second calender nip.

16. The method of claim 15, further comprising transferring the web from the second calender belt downstream of the calender nip to a support belt of a belt-supported winder.

17. The method of claim 1, wherein the coater comprises a belt-supported film transfer coater.

18. An apparatus for coating a web of paper or board comprising:

a coater comprising a means for applying a coating layer to a first side of a web, and a belt for supporting the web and for passing the web to and through the coater;

a first dryer where moisture is removed from the web, said first dryer comprising an air-cushion cylinder and a wire positioned to support a second side of the web so that the first side of the web faces said air-cushion cylinder and to receive the web from said belt of said coater; and a second dryer where moisture is removed from the web, said second dryer comprising at least one smooth-surfaced dryer cylinder, at least one air-impingement dryer cylinder, a support wire, and at least one hood, said wire of said second dryer being positioned to receive the web from said wire of said first dryer and to support the web so that the coated first side of the web wraps about a portion of a surface of said at least one smooth-surfaced dryer cylinder and so that the web wraps about a portion of a surface of said at least one airimpingement dryer cylinder so that the coated surface of the web is not in contact with the surface of said at least one air-impingement dryer cylinder, said at least one hood being positioned about said at least one air-impingement dryer cylinder for blowing drying gas against the coated web surface as the web passes about said at least one air-impingement dryer cylinder.

19. The apparatus of claim 18, wherein said first dryer futher comprises a wire-narrowing roll positioned against said wire of said first dryer to contract a width of said wire of said first dryer.

20. The apparatus of claim 19, wherein said wire-narrowing roll comprises a reverse-mounted spreading roll having roll segments.

21. The apparatus of claim 19, wherein said wire-narrowing roll comprises a grooved worm roll.

22. The apparatus of claim 19, wherein the web first contacts said wire of said first dryer at a point where the width of said wire of said first dryer is contracted by said wire-narrowing roll so that spreading of said wire of said first dryer to its natural width downstream of said point also spreads the web.

23. The apparatus of claim 19, wherein said first dryer comprises a wire-spreading roll positioned downstream of said wire-narrowing roll and against said wire of said first dryer to spread the width of said wire of said first dryer.

24. The apparatus of claim 23, wherein said wire-spreading roll comprises a spreading roll having roll segments.

25. The apparatus of claim 23, wherein said wire-spreading roll comprises a worm roll.

26. The apparatus of claim 18, further comprising a web tension measuring device positioned to measure tension of the web as the web passes from said belt of said coater to said wire of said first dryer.

27. The apparatus of claim 18, wherein the web and said wire of said first dryer wrap about a portion of the air-cushion cylinder so that the web initially faces said air-cushion cylinder in substantially the same horizontal plane as the web leaves said air-cushion cylinder.

28. The apparatus of claim 18, wherein said second dryer comprises at least two air-impingement dryer cylinders and at least two smooth-surfaced dryer cylinders, and wherein said at least two smooth-surfaced dryer cylinders are positioned in a horizontal plane.

29. The apparatus of claim 18, further comprising a pick-up cylinder positioned to transfer the web from said wire of said first dryer to said wire of said second dryer, said pick-up cylinder being positioned to contact said wire of said first dryer and said wire of said second dryer.

30. The apparatus of claim 18, further comprising a second coater to apply a coating layer to a second side of the web.

31. The apparatus of claim 18, further comprising a second coater to apply another coating layer to the first side of the web.

32. The apparatus of claim 30, further comprising a plurality of coaters to apply another coating layer to the first and second sides of the web.

33. The apparatus of claim 18, further comprising:

a first calender nip for calendering the web; and a first calender belt positioned to receive the coated web and to pass the web supported by said first calender belt through said first calender nip.

34. The apparatus of claim 30, further comprising:

a first calender nip for calendering the web; and a first calender belt positioned to receive the coated web and to pass the web supported by said first calender belt through said first calender nip.

35. The apparatus of claim 32, further comprising:

a first calender nip for calendering the web; and a first calender belt positioned to receive the coated web and to pass the web supported by said first calender belt through said first calender nip.

36. The apparatus of claim 335, further comprising:

a second calender nip for calendering the web; and a second calender belt positioned to receive the web from the first calender belt and to pass the web supported by said second calender belt through said second calender nip.

37. The apparatus of claim 34, further comprising:

a second calender nip for calendering the web; and a second calender belt positioned to receive the web from the first calender belt and to pass the web supported by said second calender belt through said second calender nip.

38. The apparatus of claim 35, further comprising:

a second calender nip for calendering the web; and a second calender belt positioned to receive the web from the first calender belt and to pass the web supported by said second calender belt through said second calender nip.

39. The apparatus of claim 36, further comprising a belt-supported winder comprising a belt positioned to receive the web from the second calender belt downstream of said second calender nip.

40. The apparatus of claim 37, further comprising a belt-supported winder comprising a belt positioned to receive the web from the second calender belt downstream of said second calender nip.

41. The apparatus of claim 38, further comprising a belt-supported winder comprising a belt positioned to receive the web from the second calender belt downstream of said second calender nip.

42. The apparatus of claim 18, wherein said coater is a film transfer coater.

43. The apparatus of claim 18, wherein said air-cushion cylinder of said first dryer and said at least one smooth-surfaced dryer cylinders of said second dryer are positioned so that the web first contacts said air-cushion cylinder of said first dryer in substantially the same horizontal plane as where the web leaves a last of said at least one smooth-surfaced dryer cylinders of said second dryer.

* * * * *